US005868014A

United States Patent [19]

Lee

[11] Patent Number: 5,868,014

[45] Date of Patent: Feb. 9, 1999

[54] SECURITY LOCKING DEVICE FOR A DESK TOP COMPUTER

[75] Inventor: Seung-un Lee, Suwon, Rep. of Korea

[73] Assignee: SamSung Electronics Co., Ltd., Suwon, Rep. of Korea

[21] Appl. No.: 768,919

[22] Filed: Dec. 18, 1996

[30] Foreign Application Priority Data

Dec. 23, 1995 [KR] Rep. of Korea ..... 1995-55147

[51] Int. Cl.[6] ..... E05B 69/00

[52] U.S. Cl. ..... 70/58; 200/50.01

[58] Field of Search ..... 70/57, 58; 361/683, 361/686; 200/50.01, 50.02, 50.18

[56] References Cited

U.S. PATENT DOCUMENTS

| | | | |
|---|---|---|---|
| 2,344,636 | 3/1944 | Quast | 200/50.18 |
| 2,635,151 | 4/1953 | Sharp | 200/50.18 |
| 3,179,761 | 4/1965 | Malota | 200/50.18 |
| 3,284,591 | 11/1966 | Daly | 200/50.18 |
| 3,348,003 | 10/1967 | Mrenna | 200/50.18 |
| 3,621,161 | 11/1971 | Mueller | 200/50.18 |
| 3,841,675 | 10/1974 | Mercer | 200/61.62 X |
| 3,932,716 | 1/1976 | Mottel et al. | 200/50.02 |
| 4,596,907 | 6/1986 | LaGreco et al. | 200/50.01 |
| 4,633,047 | 12/1986 | Mennell | 200/50.02 |
| 4,758,697 | 7/1988 | Jeuneu | 70/57 X |
| 4,777,332 | 10/1988 | Diaz | 200/50.02 |
| 4,782,971 | 11/1988 | Hill | 220/32 |
| 4,898,009 | 2/1990 | Lakoski et al. | 70/58 |
| 5,071,360 | 12/1991 | Lindow et al. | 439/133 |
| 5,077,991 | 1/1992 | Stickel et al. | 70/58 |
| 5,151,992 | 9/1992 | Nagae | 395/750 |
| 5,190,465 | 3/1993 | Davidge et al. | 70/57 X |
| 5,193,665 | 3/1993 | Jankow | 200/43.8 |
| 5,220,875 | 6/1993 | Davidge et al. | 70/57 X |
| 5,291,579 | 3/1994 | Marino | 200/50.01 X |
| 5,299,436 | 4/1994 | Spitzer | 70/58 |
| 5,311,397 | 5/1994 | Harshberger et al. | 361/683 |
| 5,327,752 | 7/1994 | Myers et al. | 70/58 |
| 5,408,058 | 4/1995 | Homik et al. | 200/50.01 |
| 5,477,041 | 12/1995 | Miron et al. | 235/382 |
| 5,506,990 | 4/1996 | Holman, Jr. | 395/750 |
| 5,548,479 | 8/1996 | Hyvärinen | 361/684 |
| 5,597,991 | 1/1997 | Chen et al. | 200/50.02 |
| 5,631,454 | 5/1997 | Hubacher et al. | 200/50.01 |
| 5,660,065 | 8/1997 | Edlund | 70/58 |
| 5,686,708 | 11/1997 | Spencer | 200/50.02 X |

*Primary Examiner*—Suzanne Dino Barrett
*Attorney, Agent, or Firm*—Robert E. Bushnell, Esq.

[57] ABSTRACT

Disclosed is a security locking device mounted on a body of a desk top computer. The locking device is key operated and allows the user to either disassemble the chassis or to turn on power to the appliance, depending on which direction and how far a key is rotated. The structure of the lock is simple as no microprocessor is used to operate the lock. Instead, a pair of contacting rods, positioned on a rotating shaft rotate onto contact plates to form electrical contact with the contacting plates, thus delivering power to the computer when the key is rotated to one of three possible positions. The computer chassis can be disassembled if the key is rotated to another of the three positions. Since the device is key operated, only authorized personnel can disassemble the device or electrically energize the device, thus protecting the computer hardware and software from theft.

8 Claims, 6 Drawing Sheets

SECURITY LOCKING DEVICE FOR A DESK TOP COMPUTER

CLAIM OF PRIORITY

This application makes claims all benefits accruing under 35 U.S.C. §119 from an application for *A Security Locking Device for a Desk Top Computer* earlier filed in the Korean Industrial Property Office on 23 Dec. 1995 and there duly assigned Ser. No. 55147/1995.

FIELD OF THE INVENTION

The present invention relates to a security locking device for a desk top computer, and more particularly, to a security locking device for a desk top computer which is convenient for a user to operate by allowing locking to be realized mechanically and electrically through a single, simple, mechanical device.

BACKGROUND OF THE INVENTION

The notion of having a locking mechanism that can both electronically engage and mechanically disengage a computer system is not entirely new. For example, U.S. Pat. No. 5,311,397 for a *Computer with Modules Readily Replaceable By Unskilled Personnel* to Harshberger et al discloses a computer module with such a key locking mechanism. In column 6, lines 11 through 45 describe a key mechanism movable between three positions is described. In one of the three positions, power is delivered to the CPU and the rest of the unit. If the key is rotated to any of the other two positions, the electrical power is disconnected. One of these remaining two positions allow for mechanical disengagement or separation of the chassis. The other of these two positions does not allow for mechanical separation of the chassis. Thus, by rotating a key, electronic power can be delivered to the computer. By rotating a key to another position, the chassis can be disassembled. The electrical connection associated with the key is microprocessor controlled in Harshberger et al.

U.S. Pat. No. 5,193,665 to for an *Electrical Plug with Disabling Means* to Jankow '665 discloses an electrical plug that is key operated so as to enable power to be engaged and disengaged by rotating the key within the socket. As the key is rotated, an electrical connection is formed between the power supply and the remainder of the circuitry, energizing the device. Jankow '665 does not pertain to a desk top computer and does not allow for the disassembly of a computer chassis.

What is needed is a simplified locking mechanism that can both electrically engage and mechanically disengage the computer with the turn of a key. Such a simplified locking mechanism would preclude the use of a microprocessor operated lock.

SUMMARY OF THE INVENTION

It is therefore an object to provide a simplified computer lock and key arrangement where a computer can be electrically energized by a lock and key arrangement without the use of complicated parts such as microprocessors.

It is also an object to allow for mechanical disengagement by operating the same key that is used to electrically energize the device.

These and other objects are achieved by having a key way integrated with a rotating shaft. The rotating shaft rotates whenever a key is inserted into the key way and turns the keyway. Protruding radially from the rotating shaft is a contacting rod that physically forms a contact with a pair of contact plates when the key is rotated to the proper position. The contacting rod and contacting plates help close a circuit and allow power to be delivered from a power supply to the remainder of the unit. Mechanical disengagement is achieved by aligning a protruding portion extending radially from the end of the rotating shaft with a coupling hole in the chassis. This proper alignment is achieved by rotating the key in the key way to a second position, allowing the front panel to be separated from the remainder of the chassis. Thus, a single key and a single key way can be used to disassemble the computer as well as electrically energize the device.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
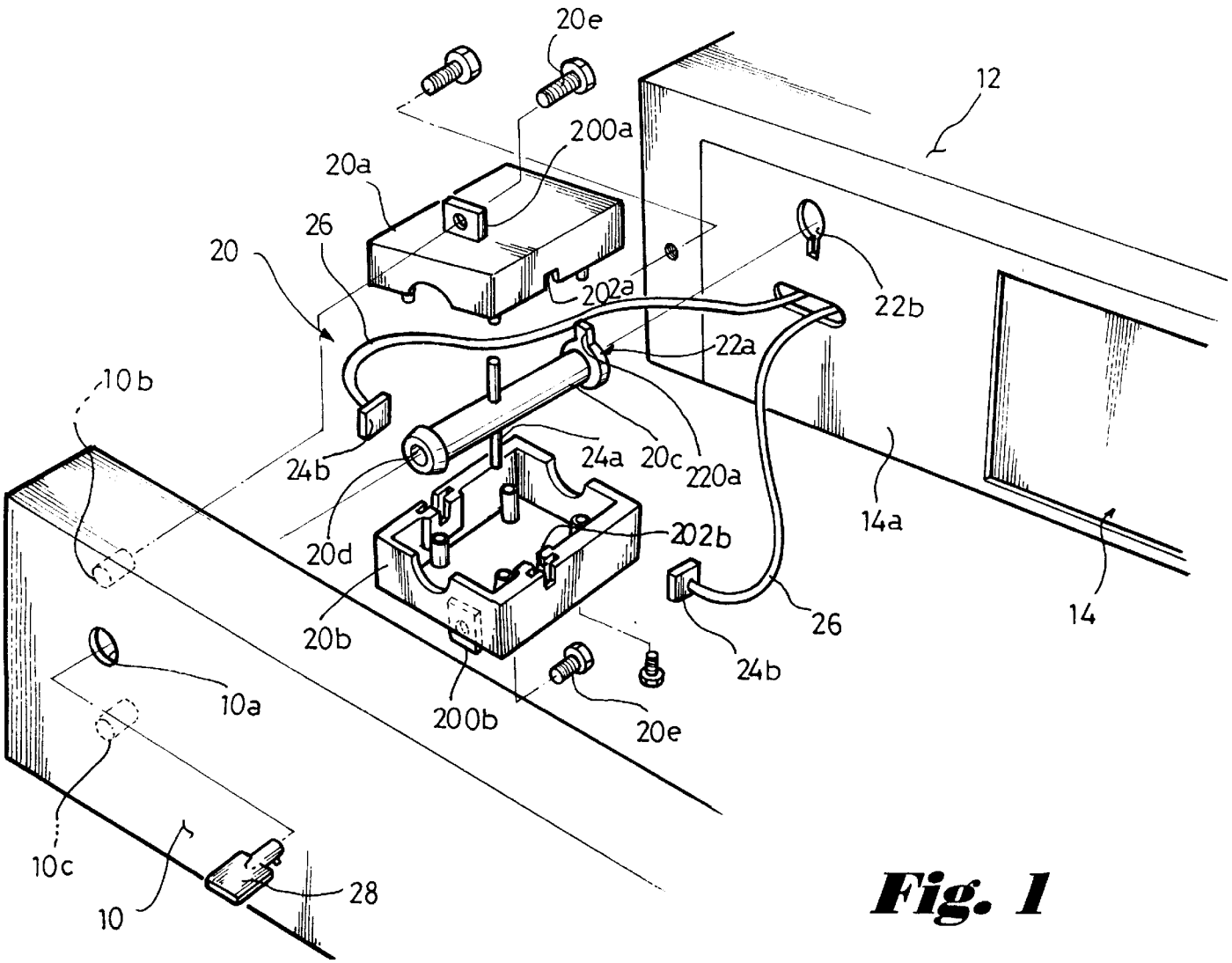
FIG. 1 is an exploded perspective view illustrating a security locking device and a body according to the present invention.
Figure 2:
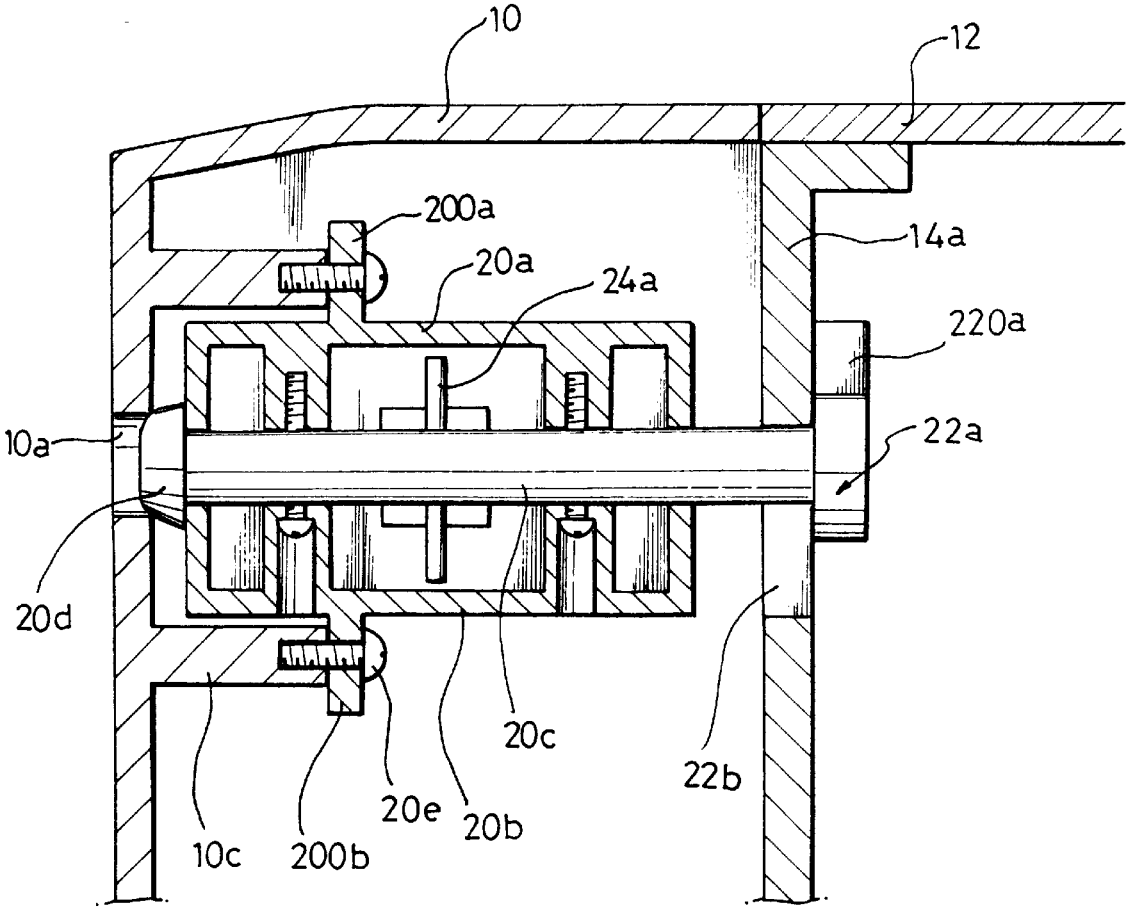
FIG. 2 is a side sectional view illustrating a coupling state of the security locking device according to the present invention.

FIG. 1 is an exploded perspective view illustrating a security locking device for a desk top computer according to the present invention and FIG. 2 is a side sectional view illustrating a coupling state of the security locking device according to the present invention, wherein a reference numeral 10 indicates a front case of a body of the computer. As in the general desk top computer, the front case 10 is removably coupled to a cover 12 of the body with screws, and a bottom chassis 14 is inserted inside the cover 12 from the backside and coupled to the cover 12 with screws.

A lock assembly 20, disposed between the front case 10 and the bottom chassis 14, comprises upper and lower cases 20*a* and 20*b* which are removably coupled to each other with screws the former having clamping portions 200*a* and 200*b* on their horizontal planes, and a rotating shaft 20*c* which is disposed inside the upper and lower cases 20*a* and 20*b* in a longitudinal direction having a key way 20*d* on its front end. The lock assembly 20 is fixed on the inner surface of the front case 10 allowing the key way 20*d* to be inserted into a hole 10*a* formed on the front case 10. In FIG. 1, the reference numeral 28 indicates a key to be inserted into the key way 20*d* and to rotate the rotating shaft 20*c* formed integrally with key way 20*d*. The lock assembly 20 is fixed by screws 20*e* passing through the clamping portions 200*a* and 200*b* and screwing into screw holes 10*b* and 10*c* integrally formed with the inner surface of the front case 10.

The inventive security locking device structured as in the above comprises a first locking means controlling the opening and closing of cover 12 according to the rotation of the rotating shaft 20*c*, and a second locking means controlling the operation of the computer. The first locking means comprises a locking portion 22*a* fixed on a rear end portion of the rotating shaft 20*c* having a protruding portion 220*a* on its circumference, and a coupling hole 22*b* passing through a vertical portion 14*a* of the bottom chassis 14 and which is identical in shape to that of the locking portion 22*a*. The locking portion 22*a* protrudes out of the lock assembly 20 and is inserted into the coupling hole 22*b* when the upper and lower cases 20*a* and 20*b* are assembled together.

Figure 3:
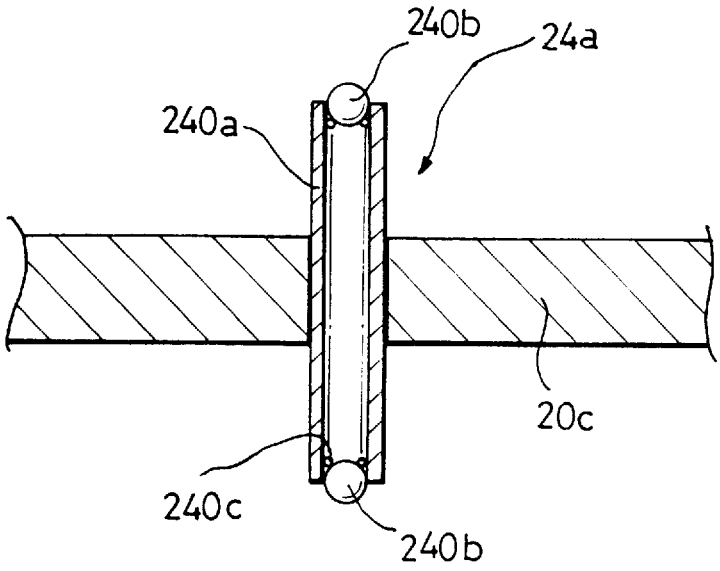
FIG. 3 is a sectional view illustrating a contacting rod according to the present invention.

Referring to FIG. 3, the second locking means comprises a contacting rod 24*a* penetrating the center of the rotating shaft 20*c* and comprising a pipe 240*a* having contacting balls 240*b* on both ends and a spring 240*c* therein for providing elastic force to the contacting balls. As shown in FIG. 1, contacting plates 24*b* are inserted into inserting grooves 202*a* and 202*b*, each formed on both sides of the upper and lower cases 20*a* and 20*b*. A power supplying cable 26 is connected to a back side of each of the contacting plates 24*b* and the front sides thereof are contacted with the contacting balls 240*b* mounted on both ends of the contacting rod 24*a*.

Figure 4:
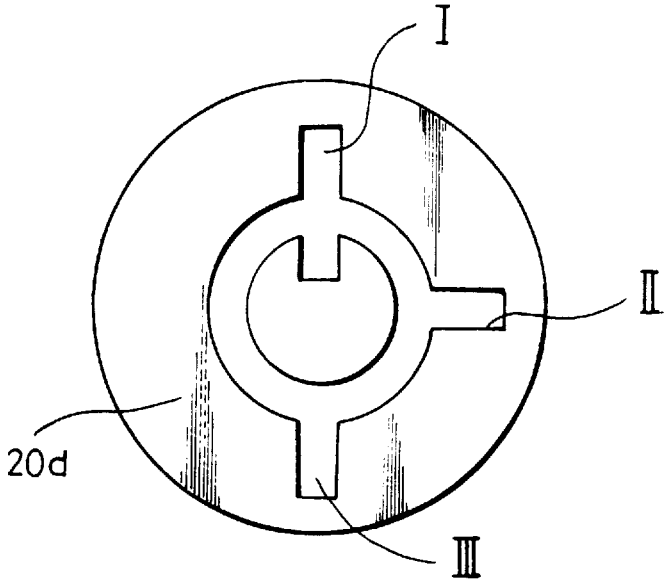
FIG. 4 is a schematic diagram illustrating a key way to describe an operation of the security locking device according to the present invention.

The operation of the inventive device will now be described with reference to FIGS. 4, 5, and 6. FIG. 4 is a schematic diagram for describing positions of the key 28 when it rotates after being inserted into the key way 20*d*, wherein I indicates an initial position when the key 28 is inserted into the key way 20*d*, II indicates a position when the key 28 is rotated clockwise by 90°, and III indicates a position when the key 28 is rotated clockwise by another 90°. The locking portion 22*a* and the rotating shaft 20*c* rotate according to the rotation of the key 28. FIGS. 5 and 6 respectively show states of the rotating shaft 20*c* and the locking portion 22*a* according to the rotation of the key 28.

Figure 5A:
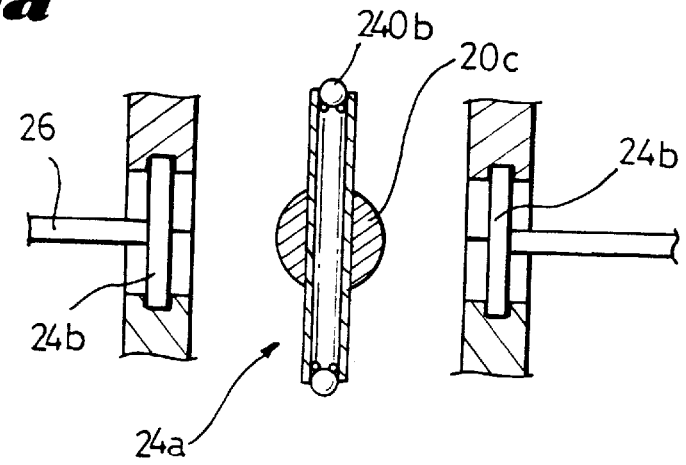
FIGS. 5A, 5B, and 5C are sectional views each illustrating an operating state of a rotating shaft according to the present invention.
Figure 6A:
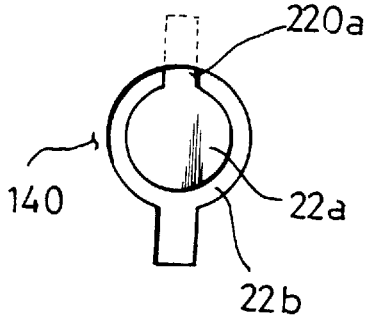
FIGS. 6A, 6B, and 6C are schematic diagrams each illustrating an operating state of a locking portion according to the present invention.

FIGS. 5A and 6A show the states of the rotating shaft 20*c* and the locking portion 22*a* when the key 28 is in position I of FIG. 4. In position I, the rotating shaft 20*c* keeps the contacting rod 24*a* in a vertical state to disallow both ends of the contacting rod 24*a* to make contact with the contacting plates 24*b*, and the locking portion 22*a* inserted into the coupling hole 22*b* is not able to be released since its protruding portion 220*a* is caught behind the vertical portion 14*a* of the chassis 14. In this state, it is impossible to operate the computer because the contacting plates 24*b* are not connected to each other, preventing electric power to be applied to the computer, and it is also impossible to open the cover 12 because the front case 10 held to the bottom chassis 14 by the locking portion 22*a*. For ease of explanation, such a state will hereinafter be referred to as a POWER OFF/LOCK ON state.

Figure 5B:
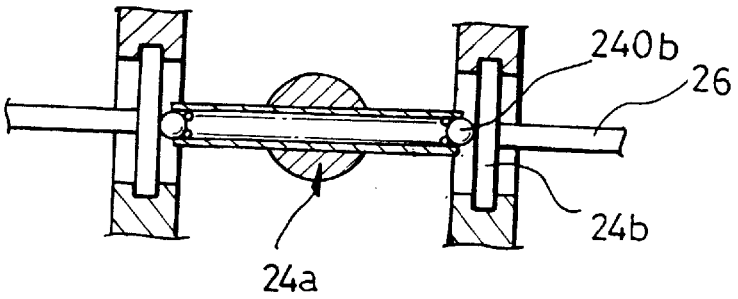
Figure 6B:
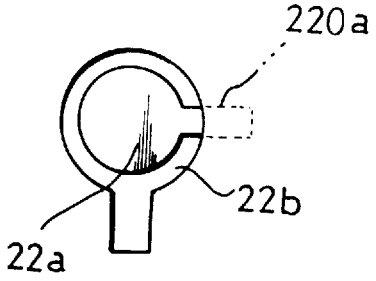
Figure 6C:
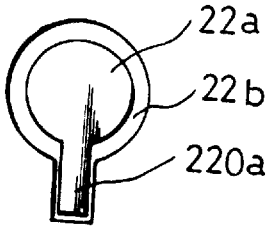
Figure 7:
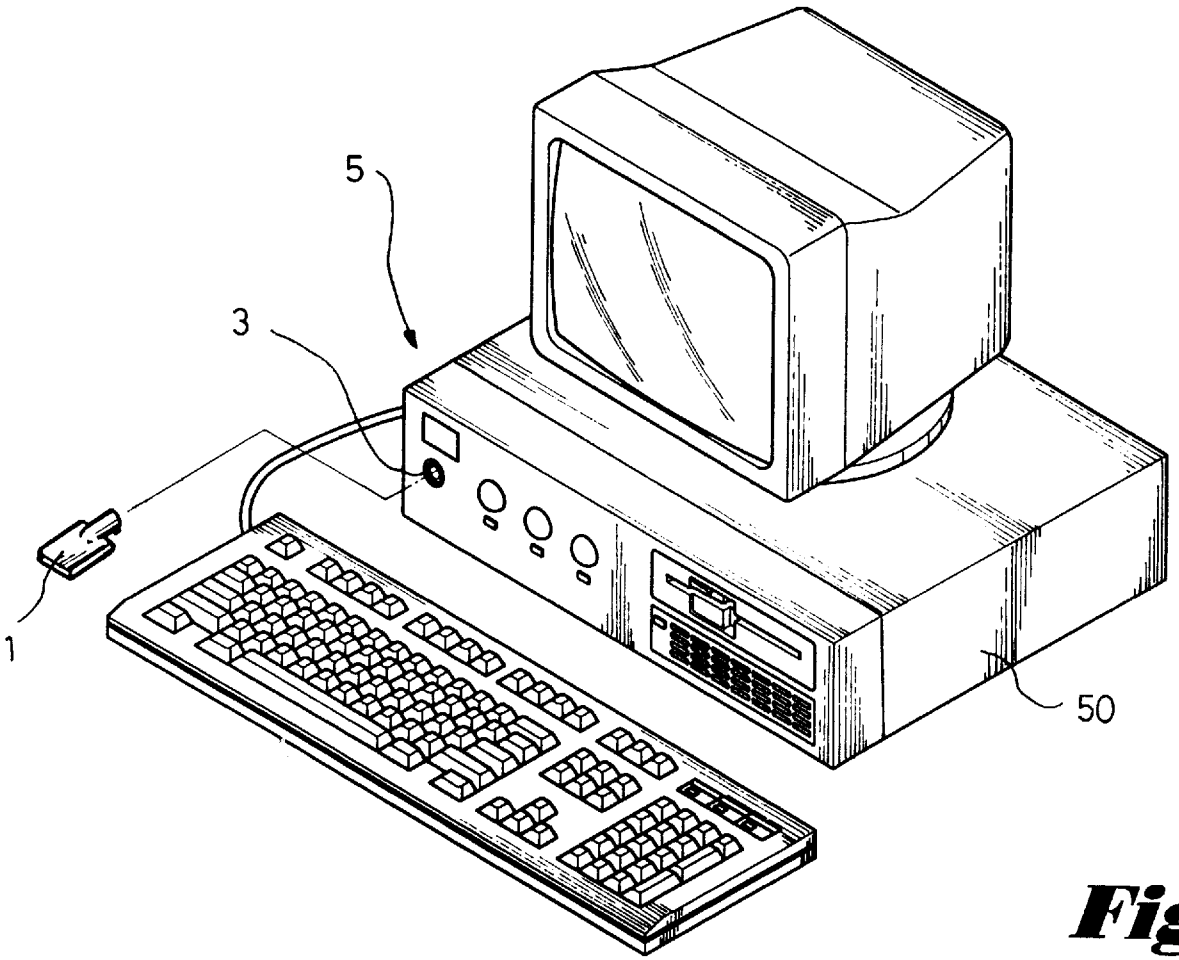
FIG. 7 is a perspective view illustrating a general desk top computer.

In the POWER OFF/LOCK ON state, if the user rotates the key 28 to position II, the rotating shaft 20*c* rotates to be in the state as shown in FIG. 5B. In this state, the contacting balls 240*b* on both ends of the contacting rod 24*a* are contacted to both contacting plates 24*b*. As a result, both contacting plates 24*b* are connected to each other and electric power is able to be applied to the computer, thereby enabling the operation of the computer. Nevertheless, it is still impossible to open the cover 12 because the protruding portion 220*a* of the locking portion 22*a* is still caught behind the vertical portion 14*a* of the chassis 14 as shown in FIG. 6B. Hereinafter, such a state will be referred to as a POWER ON/LOCK ON state. In the POWER ON/LOCK ON state, when the user wants to stop using the computer, the user may rotate the key 28 counterclockwise from position II to position I.

Figure 5C:
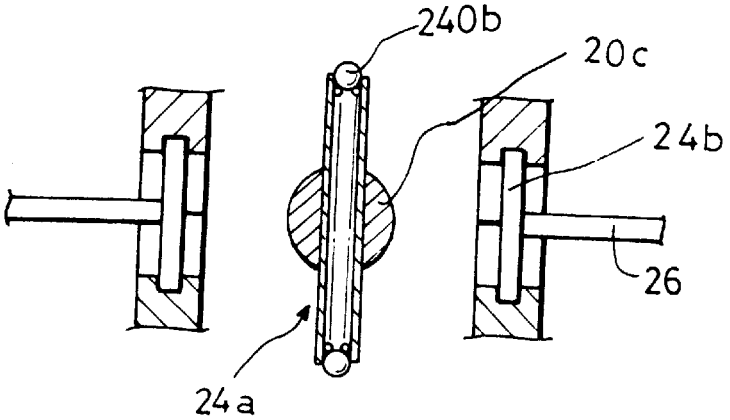

When the user wants to open the cover 12 from the POWER ON/LOCK ON state, the user may rotate the key 28 clockwise from position II to position III. When this is done, the rotating shaft 20*c* rotates clockwise as shown in FIG. 5C so that the contacting balls 240*b* are separated from the contacting plates 24*b*, stopping the supply of power. Further, when the locking portion 22*a* is rotated to position III, the shape of the locking portion 22*a* coincides with that of the coupling hole 22*b*, releasing the protruding portion 220*a* from the vertical portion 14*a* of the chassis 14. When this occurs, power is no longer supplied since the contacting plates 24*b* are separated from each other, and it is possible to open the cover 12 since the protruding portion 220*a* is released from the coupling hole 22*b* to allow the front case 10 to be disassembled from the bottom chassis 14. Such a state will be referred to as a POWER OFF/LOCK UNLOCKED state.

The operation of the present invention, therefore, may be divided into the states of POWER OFF/LOCK ON, POWER ON/LOCK ON, and POWER OFF/LOCK UNLOCKED, according to the rotation of the key 28 inserted into the key way 20*d*. As a result, the security locking device for desk top computers according to the present invention combines the mechanical function of controlling the opening and closing of the cover and the electrical function of controlling the operation of the computer according to the rotation of the rotating shaft. Accordingly, the present invention provides the security locking device for desk top computers which allows the key inserted into the key way to be used for both mechanical and electrical locking, overcoming the disadvantages of the conventional device. In addition, the present invention provides an additional advantage of design in that the inventive device allows the power to be turned ON/OFF by the rotation of the key so that a power switch is not required for the desk top computer employing the inventive device.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. An electrical appliance capable of electrically and mechanically being locked, said electrical appliance comprising:

a shaft having an axis and having a first end and a second end, said shaft rotatable about said axis to a first position, a second position, and a third position;

a key way formed integrally to said first end of said shaft;

a key that can be inserted into said key way causing said key way and said shaft to rotate;

a protruding portion at said second end of said shaft;

a front panel perforated by an aperture to accommodate said key way;

a bottom portion of a chassis, said bottom portion having a vertical portion, said vertical portion perforated by a coupling hole having a shape identical to that of said protruding portion located at said second end of said shaft;

a contacting rod extending through said axis of said shaft and extending radially from said shaft between said first end and said second end of said shaft, said contacting rod having a first end and a second end; and a pair of contacting plates, each of said pair of contacting plates forming electrical contact to a respective one of said first end and said second end of said contacting rod when said rotating shaft is rotated to said first position.

2. The electrical appliance of claim 1, wherein said front panel is able to separate from said bottom portion of said chassis when said shaft is rotated to said second position, allowing said protruding portion to pass through said coupling hole in said bottom portion of said chassis.

3. The electrical appliance of claim 2, wherein said contacting rod further comprises:

a pipe;

a pair of contacting balls, one of said pair of contacting balls respectively located at each end of said pipe, said pair of contacting balls respectively forming electrical contact to each one of said pair of contacting plates; and a spring located inside said pipe for providing elastic force to said pair of contacting balls.

4. A locking device for an electronic appliance, comprising:

a key for operating said locking device;

a key way into which said key is inserted into and rotated;

a rotating shaft having an axis and having a first end and a second end, said key way formed integrally to said first end of said rotating shaft, said rotating shaft rotatable to a first position, a second position, and a third position about said axis;

a pair of contacting rods extending radially from said rotating shaft between said first end and said second end of said rotating shaft; and a pair of contacting plates, each of said pair of contacting plates forming electrical contact to a respective one of each of said pair of contacting rods when said rotating shaft is rotated to said first position, said pair of contacting plates and said pair of contacting rods allowing power to be delivered to said electronic appliance.

5. The locking device of claim 4, wherein said rotating shaft has a radial protrusion on said second end of said rotating shaft that prevents disassembly of said electronic appliance unless said radial protrusion is rotated to said second position so as to be aligned with an aperture having the same shape as said radial protrusion.

6. The locking device of claim 4, wherein said pair of contacting rods further comprises:

a pipe;

a pair of contacting balls, one of said pair of contacting balls respectively located at each end of said pipe, said pair of contacting balls for respectively forming electrical contact to each one of said pair of contacting plates; and a spring located inside said pipe for providing elastic force to said pair of contacting balls.

7. A security locking device for a desk top computer, comprising:

a rotating shaft, said rotating shaft having a front end portion and a rear end portion;

a key way said key way being mounted on said front end portion of said rotating shaft;

a lock assembly fixed on an inner surface of a front case for said desk top computer said lock assembly having an upper case and a lower case said lock assembly for allowing said key way to be exposed outside said front case;

a first locking means, said first locking means being mounted on said rear end portion of said rotating shaft, said first locking means for controlling the opening and closing of a cover for said desk top computer according to the rotation of said rotating shaft;

a second locking means, said second locking means being mounted on side portions of said upper case and said lower case of said lock assembly and on said rotating shaft, said second locking means for controlling the electric power operation of said desk top computer according to the rotation of said rotating shaft said second locking means comprising a contacting rod having two ends, said contacting rod passing through a center portion of said rotating shaft and two contacting plates, said two contacting plates for respective connection to power supplying cables for enabling each one of said two contacting plates to form electrical contact to a respective one of said two ends of said contacting rod; and a key for insertion into said key way for rotating said rotating shaft.

8. The security locking device of claim 7, wherein said first locking means comprises:

a locking portion mounted on said rear end portion of said rotating shaft said locking portion having a protruding portion on a circumference of said locking portion; and a coupling hole, said coupling hole formed on a vertical portion of a bottom chassis of said desk top computer, said coupling hole being identical in shape to that of said locking portion to allow for insertion of said locking portion into said coupling hole.

* * * * *